US009804632B2

(12) United States Patent
Gassner

(10) Patent No.: US 9,804,632 B2
(45) Date of Patent: Oct. 31, 2017

(54) FAST EMBEDDED HAND CONTROLLER

(71) Applicant: LIMOSS (SHENZHEN) CO.,LTD, Shenzhen (CN)

(72) Inventor: Christian Gassner, Shenzhen (CN)

(73) Assignee: LIMOSS (SHENZHEN) CO.,LTD, Shenzhen (CN)

( * ) Notice: Subject to any disclaimer, the term of this patent is extended or adjusted under 35 U.S.C. 154(b) by 231 days.

(21) Appl. No.: 14/919,999

(22) Filed: Oct. 22, 2015

(65) Prior Publication Data

US 2017/0031381 A1 Feb. 2, 2017

(30) Foreign Application Priority Data

Jul. 31, 2015 (CN) ..... 2015 2 0568077 U

(51) Int. Cl.
*G05G 1/02* (2006.01)

(52) U.S. Cl.
CPC ..... *G05G 1/02* (2013.01)

(58) Field of Classification Search
CPC ..... G05G 1/02; H01H 3/02; H01H 3/022; H01H 3/12; H01H 3/122; H01H 9/02; H01H 9/0235; H01H 13/023; H01H 13/04; H01H 13/06; H01H 13/063; H01H 13/10; H01H 13/12; H01H 13/14; H01H 13/36; H01H 13/70; H01H 13/86; H01H 21/24; H01H 25/065
USPC ..... 200/296
See application file for complete search history.

(56) References Cited

U.S. PATENT DOCUMENTS 8,308,494 B1 * 11/2012 Zhao ..... H01R 13/60 439/131
8,766,115 B2 * 7/2014 Kristen ..... H01H 13/86 200/5 A
2011/0198894 A1 * 8/2011 Hsieh ..... A47C 1/0242 297/68
2011/0261511 A1 * 10/2011 Alderson ..... H01H 13/86 361/679.01
2014/0353134 A1 * 12/2014 Muller ..... H01H 3/20 200/5 A

* cited by examiner

*Primary Examiner* — Edwin A. Leon
(74) *Attorney, Agent, or Firm* — Anova Law Group, PLLC

(57) ABSTRACT

The present disclosure provides an instant embedded manual control, which has a remote control; and a face shell containing the remote control. The face shell is provided with groups of positioning ribs that are used to embed the manual control into a carrier platform of the manual control; the face shell is also provided with a plurality of cone structures that are used to fix the manual control into the carrier platform by being inserted into a leather surface of the carrier platform when the manual control is embedded in the carrier platform; and at least one button is arranged on the face shell.

9 Claims, 4 Drawing Sheets

FAST EMBEDDED HAND CONTROLLER

CROSS-REFERENCES TO RELATED APPLICATIONS

This application claims the priority of Chinese patent application No. 201520568077.9, filed on Jul. 31, 2015, the entire contents of all of which are incorporated herein by reference.

FIELD OF THE INVENTION

The present invention relates to the field of remote control, and more particularly, to an instant embedded manual control.

BACKGROUND

Currently, the installation methods of embedded remote control are in general complicated, and an embedded remote control is often fixed to a carrier platform by screws or special glue. Therefore, the installers need more stringent requirements to go through professional training before being able to perform such installations. It brings great challenges for the end customers who want to personalize product placement locations, and a little carelessness may cause damage to the carrier platform.

The disclosed foldable electronic device is directed to solve one or more problems set forth above and other problems in the art.

BRIEF SUMMARY OF THE DISCLOSURE

One aspect of the present disclosure includes an instant embedded manual control. The instant embedded manual control includes a remote control; and a face shell containing the remote control. The face shell is provided with groups of positioning ribs that are used to embed the manual control into a carrier platform of the manual control; the face shell is also provided with a plurality of cone structures that are used to fix the manual control into the carrier platform by being inserted into a leather surface of the carrier platform when the manual control is embedded in the carrier platform; and at least one button is arranged on the face shell.

Optionally, the remote control is cylindrical, rectangular, cubic, prismatic or spherical.

Optionally, the face shell is surrounded by a single group or groups of positioning ribs.

Optionally, the positioning ribs comprise a first group of positioning ribs and a second group of positioning ribs; and the first group of positioning ribs and the second group of positioning ribs both include single or multiple positioning ribs.

Optionally, a single or a plurality of cone structures are arranged on the face shell.

Optionally, a cross-sectional shape of the face shell is round, oval or polygon.

Optionally, a cross-sectional shape of the button is semicircle, crescent or polygon.

Optionally, the button is provided with a backlight structure.

Optionally, a circular line is provided to circle the button.

Thus, according to the disclosed embodiments of the present invention, the instant embedded manual control comprises a remote control, and a face shell containing the remote control. The face shell is provided with groups of positioning ribs that are used to embed the manual control into the carrier platform of the manual control. The face shell is also provided with cone structures that are used to fix the manual control on the carrier platform. When the manual control is embedded in the platform, the cone structures are inserted into the leather surface of the carrier platform. The buttons are arranged on the face shell. To install the instant embedded manual control, only an installation opening is required to be reserved in the carrier platform to match the manual control, and the manual control can be embedded in the carrier platform with moderate pressure on the face shell and the remote control is engaged on the carrier platform by the positioning ribs, without using screws or special glue, avoiding tedious operation in the installation and achieving instant installation.

DETAILED DESCRIPTION

The present invention provides an instant embedded manual control. In order to make the purpose, technical solutions, and the advantages of the present invention clearer and more explicit, descriptions detailed embodiments of the present invention are provided and illustrated in the accompanying drawings. Wherever possible, the same reference numbers will be used throughout the drawings to refer to the same or like parts. It should be understood that the exemplary embodiments described herein are only intended to illustrate and explain the present invention and not to limit the invention.

Figure 1:
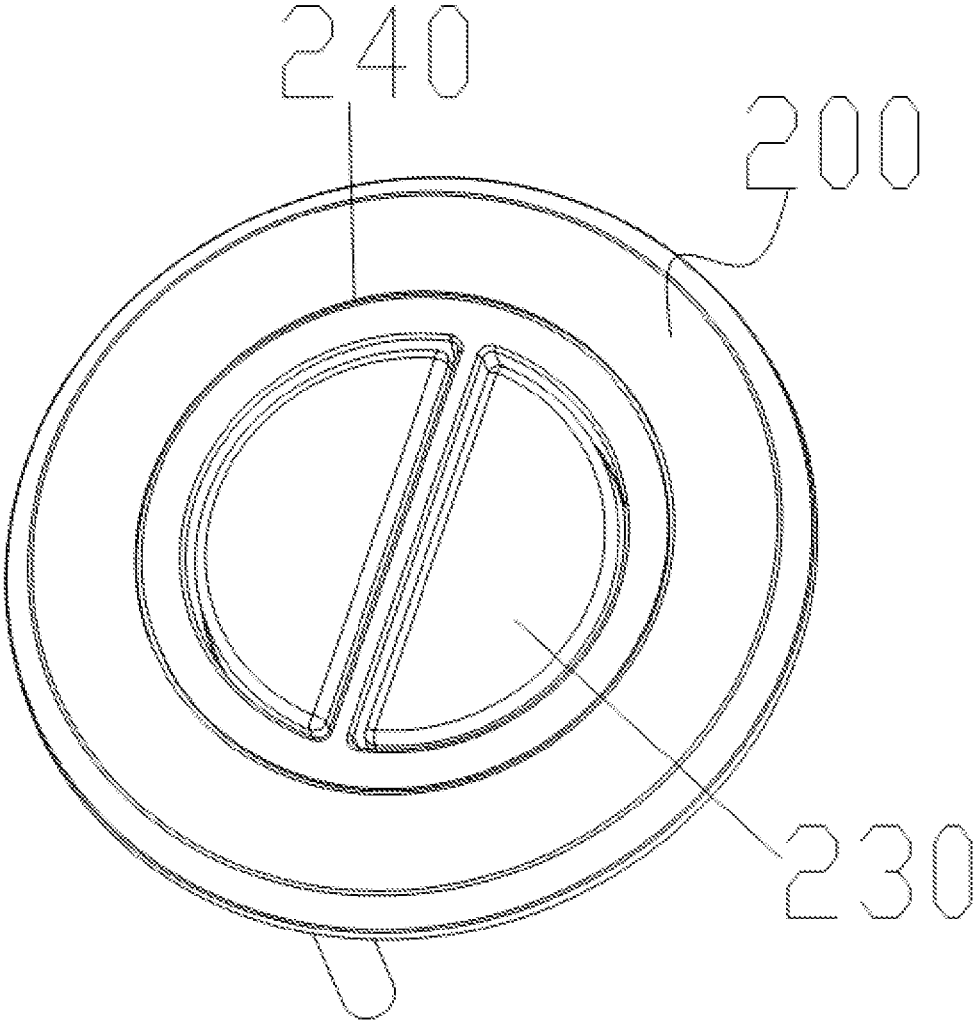
FIG. 1 illustrates a perspective view of an exemplary instant embedded manual control from a first angle consistent with the disclosed embodiments.
Figure 2:
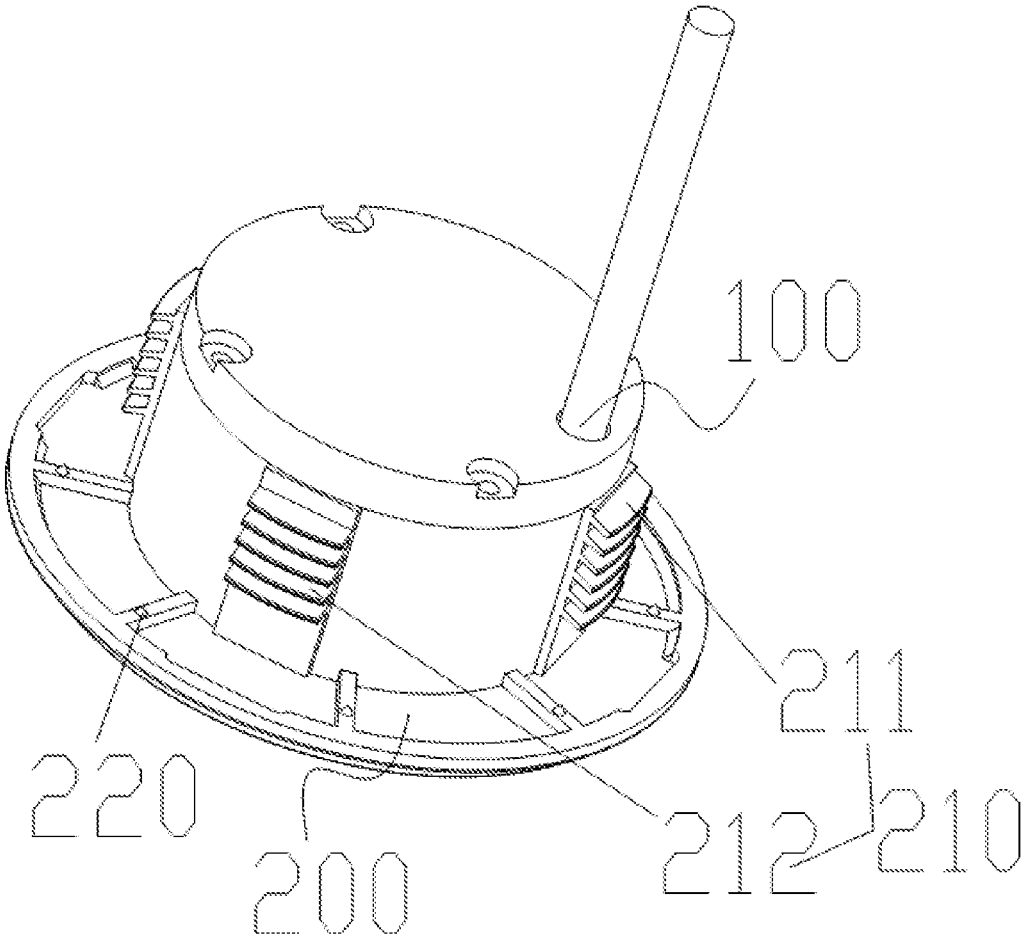
FIG. 2 illustrates a perspective view of an exemplary instant embedded manual control from a second angle consistent with the disclosed embodiments.

Referring to FIG. 1, FIG. 2 and FIG. 3*a*-3*d* together, wherein, FIG. 1 illustrates a perspective view from a first angle of an instant embedded manual control consistent with the disclosed embodiments. FIG. 2 illustrates a perspective view from a second angle of the instant embedded manual control consistent with the disclosed embodiments. FIG. 3*a*-3*d* illustrates schematic diagrams of the first state to fourth state of an installation process of the instant embedded manual control consistent with the disclosed embodiments respectively.

As shown in the Figures, the present invention provides an instant embedded manual control. The instant embedded manual control comprises a remote control 100, and a face shell 200 containing the remote control 100. The remote control 100 may be used to manually control certain target device or equipment, such as a motor, a machinery, or any appropriate equipment.

The remote control 100 is fitted into the face shell 200 such that the face shell 200 and the remote control 100 can be used together for installation of the remote control 100 on any suitable location on a carrier platform 10 selected by a user of the remote control 100.

The face shell 200 is provided with groups of positioning ribs 210 that are used to embed the manual control into the carrier platform 10 of the manual control. The face shell 200 is also provided with one or more cone structures 220 that are used to fix the manual control on the carrier platform 10. For example, when the manual control is embedded in the carrier platform 10, the cone structures 220 are pushed or inserted into a leather surface of the carrier platform 10. Further, at least one button 230 is arranged on the face shell 200 to control the remote control 100 for manual operation.

In specific implementations, the remote control 100 can have a body in cylindrical, rectangular parallelepiped, cubic, prismatic or spherical shape. The shape of the face shell 200 containing or cladding the remote control 100 matches the shape of the remote control 100. The body of face shell 200 is surrounded by one group or multiple groups of positioning ribs 210. A plurality of positioning ribs may be arranged in parallel along a vertical direction on the body of the face shell 200 to form a group of positioning ribs 210, and each positioning rib is arranged perpendicular to the surface of the body of the face shell 200 or in a predetermined angle to increase positioning strength.

Groups of positioning ribs 210 may be evenly distributed around the surface of the body of the face shell 200. For example, when 4 groups of positioning ribs 210 are disposed on the face shell 200, each groups of positioning ribs are arranged with a 90 degree circular angle among one another. Referring to FIG. 2, the groups of positioning ribs 210 include a first group of positioning ribs 211 and a second group of positioning ribs 212; and the first group of positioning ribs 211 and the second group of positioning ribs 212 are positioned by a circular angle of 90°. Other arrangements may also be used.

In order to facilitate the installation of manual control, referring to FIG. 2 again, the vertical distance between the bottom of the first group of positioning ribs 211 and the bottoms of the face shell 200 is less than the vertical distance between the bottom of the second group of positioning ribs 212 and the bottoms of the face shell 200; the first group of positioning ribs 211 and the second group of positioning ribs 212 both include a single or multiple positioning ribs.

FIG. 3*a*-3*d* illustrates the schematic diagram of the first state to fourth state (i.e., four states) of the installation process of the instant embedded manual control consistent with the disclosed embodiments respectively. When installing the instant embedded manual control, the following four steps may be used.

Figure 3A:
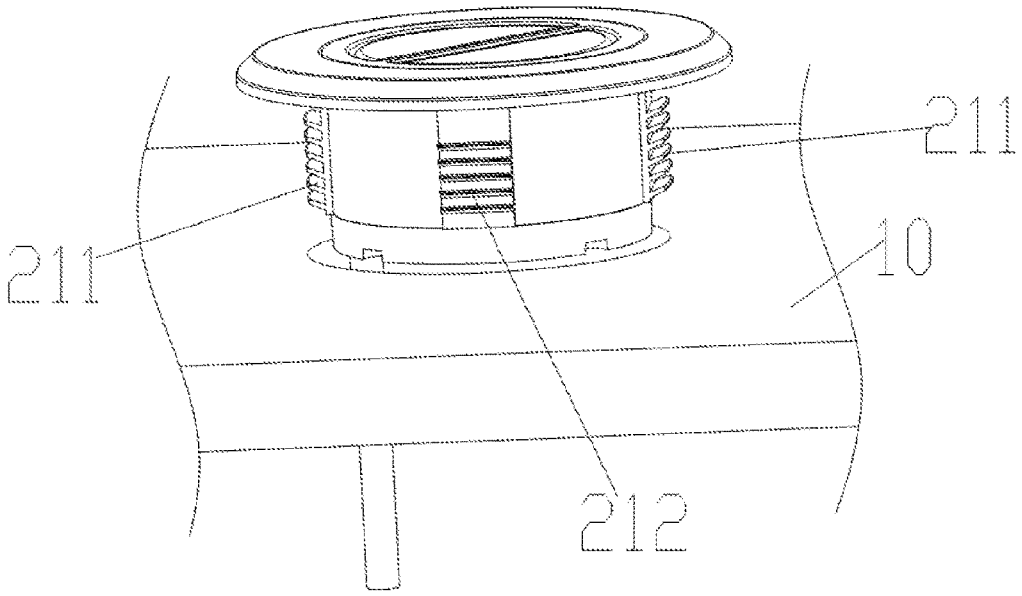
FIG. 3*a* illustrates a schematic diagram of a first state of an installation process of the instant embedded manual control consistent with the disclosed embodiments.
Figure 3B:
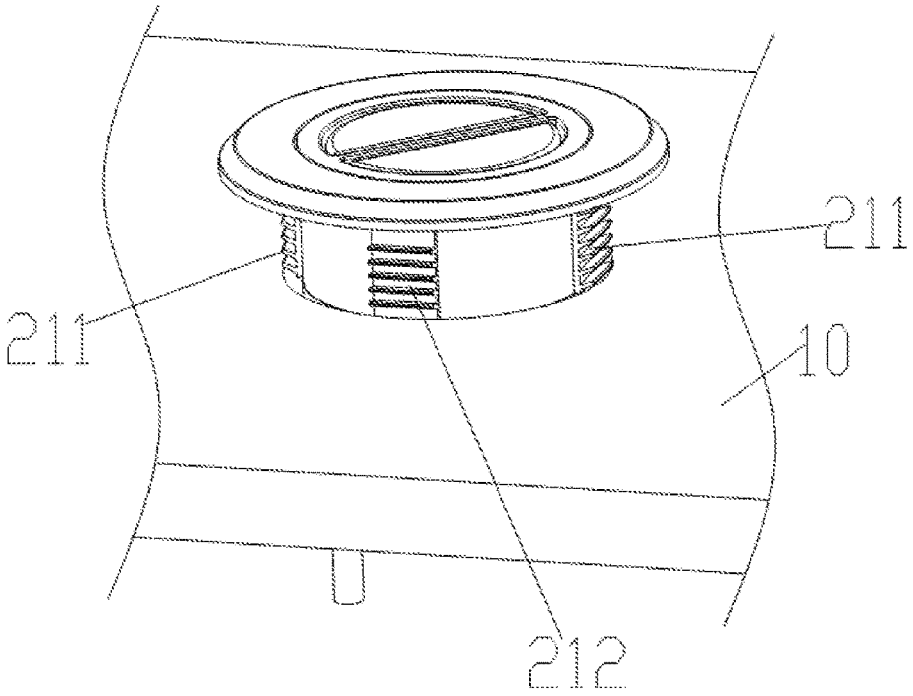
FIG. 3*b* illustrates a schematic diagram of a second state of an installation process of the instant embedded manual control consistent with the disclosed embodiments.
Figure 3C:
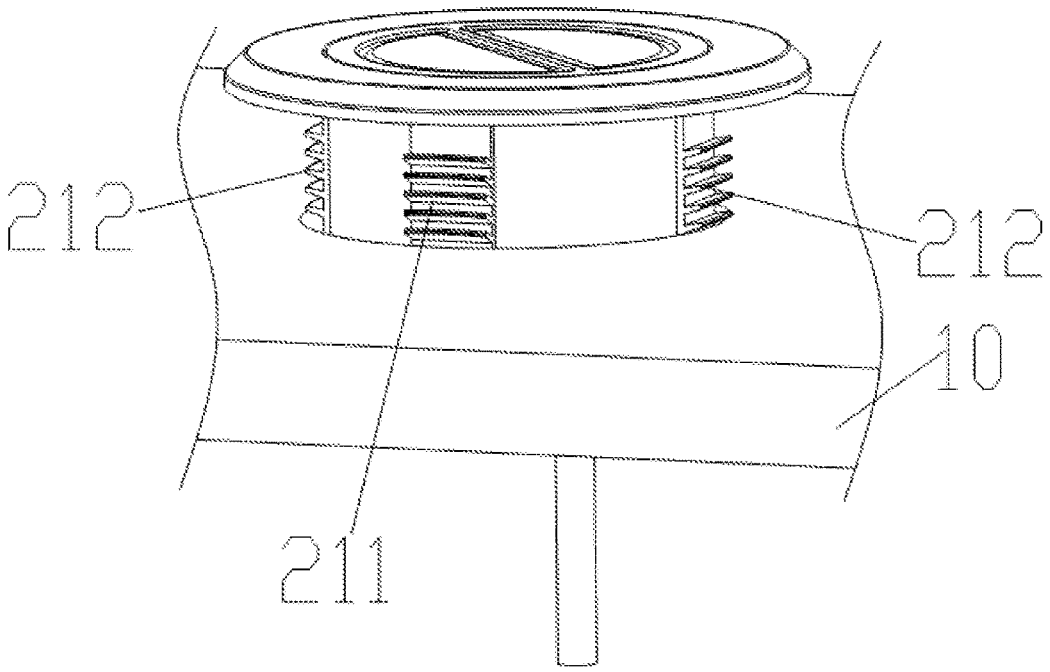
FIG. 3*c* illustrates a schematic diagram of a third state of an installation process of the instant embedded manual control consistent with the disclosed embodiments.
Figure 3D:
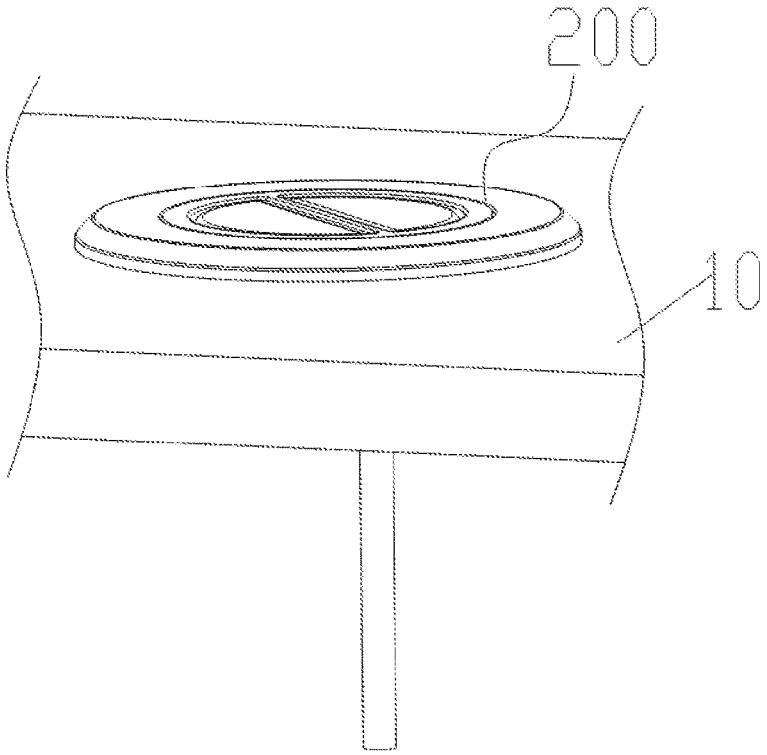
FIG. 3*d* illustrates a schematic diagram of a fourth state of an installation process of the instant embedded manual control consistent with the disclosed embodiments.

1) Referring to FIG. 3*a*, the remote control 100 is placed above an installation opening in the carrier platform 10 of the manual control and is aligned with the installation opening.
2) Referring to FIG. 3*b*, pressing the face shell 200 to cause the positioning rib at the bottom of the first group of positioning ribs 211 of the remote control 100 to be embedded in the carrier platform 10 of the manual control, i.e., to be fitted into the installation opening on the carrier platform 10.
3) Referring to FIG. 3*c*, continuing pressing the face shell 200 to cause the positioning rib at the bottom of the second group of positioning ribs 212 be embedded in the carrier platform 10 of the manual control, i.e., to be fitted into the installation opening on the carrier platform 10.
4) Referring to FIG. 3*d*, continuing pressing the face shell 200 to cause the instant embedded manual control fully embedded in the carrier platform 10 of the manual control.

Thus, when the user installs the manual control, the manual control is embedded in the carrier platform 10 with moderate pressure on the face shell 200, and the remote control is engaged on the carrier platform by the positioning ribs, without using screws or special glue, to avoid tedious operation in the installation process.

Further, as shown in FIG. 2, a single or a plurality of cone structures 220 are arranged on the face shell 200. By configuring the cone structure 220 on the contacting surface of the face shell 200 with respect to the carrier platform 10, when the remote control 100 is fully embedded in the installation opening of the carrier platform 10, the cone structures 220 can be fully embedded into the leather surface or other software material surface of the carrier platform 10 of the manual control. Thus, the manual control can completely fit in the carrier platform 10. Due to the high degree of integration between the embedded manual control and the carrier platform, the appearance of the final product may be more coordinated.

In specific implementations of the present invention, the cross-sectional shape of the face shell 200 may be circular, oval or polygon. That is, the shape of the face shell 200 can be in various shapes, such as circular, oval or polygon. The different shapes of the face shell 200 can provide consumers with different options. That is, consumers can choose a variety of products, so that the appearance of products has diversity.

Further, as shown in FIG. 1, in the instant embedded manual control consistent with the disclosed embodiments, the front of the face shell 200 is provided with buttons 230, and operating the buttons 230 on the face shell 200 can perform remote-control of a target motor and other terminals. That is, the buttons 230 can be used to operate the remote control 100 to send control signals to target devices, such as the motor or other terminals. The number of buttons 230 is at least two. In one embodiment, the number of buttons 230 is two.

Further, the buttons 230 are configured with a backlight structure (not shown). When the buttons 230 are pressed, the backlight structure may emit light of different color to make the button 230 less monotonous. The backlight structure can emit light of blue, red, green, yellow or other color. Of course, the backlight structure of the invention is not only limited to the above color and other color may also be used.

Further, as shown in FIG. 1, the buttons 230 can also be set to different shapes. Specifically, the cross-sectional shape of the button 220 can be circular, semicircular, crescent, or polygon, making the appearance of products more desirable. Further, as shown in FIG. 1, a circular belt or line 240 may be provided to circle the buttons 230.

Thus, according to the disclosed embodiments of the present invention, the instant embedded manual control comprises a remote control, and a face shell containing the remote control. The face shell is provided with groups of positioning ribs that are used to embed the manual control into the carrier platform of the manual control. The face shell is also provided with cone structures that are used to fix the manual control on the carrier platform. When the manual control is embedded in the platform, the cone structures are inserted into the leather surface of the carrier platform. The buttons are arranged on the face shell. To install the instant embedded manual control, only an installation opening is required to be reserved in the carrier platform to match the manual control, and the manual control can be embedded in the carrier platform with moderate pressure on the face shell and the remote control is engaged on the carrier platform by the positioning ribs, without using screws or special glue, avoiding tedious operation in the installation and achieving instant installation.

The embodiments disclosed herein are exemplary only. Other applications, advantages, alternations, modifications, or equivalents to the disclosed embodiments are obvious to those skilled in the art and are intended to be encompassed within the scope of the present disclosure.

What is claimed is:

1. An embedded manual control, comprising: a remote control; and a face shell containing the remote control, wherein: the face shell is provided with separate groups of positioning ribs, the groups of positioning ribs extend perpendicularly from a bottom surface of the face shell and are used to embed the manual control into a carrier platform of the manual control; the face shell is also provided with a plurality of cone structures that are used to fix the manual control into the carrier platform by being inserted into a leather surface of the carrier platform when the manual control is embedded in the carrier platform; and at least one button is arranged on the face shell.

2. The embedded manual control according to claim 1, wherein the remote control is cylindrical, rectangular, cubic, prismatic or spherical.

3. The embedded manual control according to claim 1, wherein the face shell is surrounded by the plurality of groups of positioning ribs.

4. The embedded manual control according to claim 3, wherein:

the groups of positioning ribs comprise a first group of positioning ribs and a second group of positioning ribs; and the first group of positioning ribs and the second group of positioning ribs both include multiple positioning ribs.

5. The embedded manual control according to claim 1, wherein the plurality of cone structures are arranged on the face shell.

6. The embedded manual control according to claim 1, wherein a cross-sectional shape of the face shell is round, oval or polygon.

7. The embedded manual control according to claim 1, wherein a cross-sectional shape of the button is semicircle, crescent or polygon.

8. The embedded manual control according to claim 7, wherein the button is provided with a backlight structure.

9. The embedded manual control according to claim 1, wherein a circular line is provided to circle the button.

* * * * *